US006358468B1

(12) United States Patent
VanderJagt

(10) Patent No.: US 6,358,468 B1
(45) Date of Patent: Mar. 19, 2002

(54) APPARATUS AND METHOD FOR METERING MOLTEN METAL

(76) Inventor: Adrian D. VanderJagt, 317 Birney St., Essexville, MI (US) 48732

( * ) Notice: Subject to any disclaimer, the term of this patent is extended or adjusted under 35 U.S.C. 154(b) by 0 days.

(21) Appl. No.: 09/464,503

(22) Filed: Dec. 15, 1999

Related U.S. Application Data

(60) Provisional application No. 60/113,063, filed on Dec. 21, 1998.

(51) Int. Cl.[7] ..... C21C 5/42
(52) U.S. Cl. ..... 266/239; 266/236
(58) Field of Search ..... 266/239, 236; 222/591, 590, 594

(56) References Cited

U.S. PATENT DOCUMENTS

| | | | | | |
|---|---|---|---|---|---|
| 2,846,740 | A | | 8/1958 | Edstrand | |
| 3,448,898 | A | | 6/1969 | Bennett | 222/152 |
| 3,472,942 | A | | 10/1969 | Campbell | 222/152 |
| 3,529,753 | A | | 9/1970 | Mack | |
| 3,581,767 | A | * | 6/1971 | Jackson | 266/239 |
| 3,800,986 | A | | 4/1974 | Stamp | 222/146 |
| 4,078,706 | A | | 3/1978 | Hanuszczak | 222/596 |
| 4,356,940 | A | | 11/1982 | Ansorge | 222/596 |
| 4,428,413 | A | | 1/1984 | Lester | 164/155 |
| 4,460,163 | A | | 7/1984 | Hornung | 266/95 |
| 4,593,741 | A | | 6/1986 | Caugherty | 164/337 |
| 4,793,596 | A | | 12/1988 | Kubota et al. | 266/44 |
| 4,881,670 | A | | 11/1989 | Yamaoka et al. | 222/590 |
| 5,092,499 | A | * | 3/1992 | Sodderland | 266/239 |
| 5,443,187 | A | | 8/1995 | Samuelson | 222/595 |
| 5,948,352 | A | * | 9/1999 | Vander Jagt et al. | 266/239 |

* cited by examiner

*Primary Examiner*—Scott Kastler

(57) ABSTRACT

Apparatus for pumping molten metal up a discharge pipe and into a casting mold or die cast shot sleeve and holding the metal at its highest point in the discharge pipe while replenishing the pumping chamber with molten metal for the next specific volume of molten metal to be pumped up the discharge pipe without allowing metal to flow backward in the discharge pipe at any time. The apparatus consists of a submerged pump vessel charged and discharged by a pump piston in the submerged vessel operated from above the level of the melt. A single stopper rod acts as the valve, operated from above the level of the melt to allow molten metal into a pumping chamber while at the same time holding the previous charge in the discharge pipe. Opening the stopper rod closes the inlet and allows the piston to force molten metal up the discharge pipe.

7 Claims, 4 Drawing Sheets

INTAKE STROKE

APPARATUS AND METHOD FOR METERING MOLTEN METAL

This application claims the benefits of U.S. provisional application Ser. No. 60/113,063 filed on Dec. 21, 1998.

BACKGROUND OF THE INVENTION

Ordinary piston pumps and sliding valves have not been sufficiently successful to be widely used for molten aluminum and magnesium because of the abrasive oxides present in suspension in the melt. Sliding valves used to hold molten metal in a discharge pipe must have clearance to operate and this clearance allows leakage down the discharge pipe. Since the volume of leakage will vary with the time between cycles, the leakage will adversely affect the volume of the next pump cycle.

Gas displacement methods, with and without valves in the molten metal, are being used to meter molten metals, however the lack of positive control of metal displacement results in insufficient accuracy of metal charge size. Metal pumped by gas displacement pumps suffer from contamination from oxygen in the air and both oxygen and hydrogen in the humidity in the air. Expensive inert gases used to reduce contamination of the melt are generally not a practical economic substitute for compressed air.

An object of this invention is to provide pumping apparatus for accurately metering molten metal.

Another object of this invention is to maintain a molten metal discharge pipe full throughout the operation of the pumping apparatus.

An additional object of this invention is to provide pumping apparatus to dispense metal that has not been contaminated by air or humidity in the ambient air.

A further object of this invention is to provide a piston type displacement pumping apparatus with self cleaning characteristics.

A further object of this invention is to simplify the construction of pumping apparatus and its operation by using a stopper rod to hold molten metal in a discharge pipe and have it act as a valve to allow the pumping apparatus to take in a charge in an intake stroke while holding the metal in the discharge pipe.

SUMMARY OF THE INVENTION

Pumping apparatus in accordance with the invention comprises a submerged, or partially submerged, pump vessel or body equipped with a combined inlet and outlet valve on a stopper rod. The stopper rod serves to both hold metal in an outlet pipe connected to the vessel and also permit molten metal to be drawn through an inlet orifice into a pumping chamber of the vessel during an intake stroke of a piston. Lifting of the stopper rod closes the inlet orifice to the vessel and communicates the pumping chamber to an outlet orifice. Extending the piston into the vessel in a pump stroke forces metal through the now open outlet orifice and up the outlet pipe to dispense the molten metal in a measured amount. The amount of metal dispensed is dependent on the length of the stroke of the piston and other parameters. The length of the piston stroke may be mechanically adjusted or electronically adjusted as required to provide a desired volume of metal.

BRIEF DESCRIPTION OF THE DRAWINGS

FIGS. 1B and 1D are taken 90° to FIGS. 1A and 1C, respectively.

FIG. 3 is taken 90° to FIG. 2.

DESCRIPTION OF THE INVENTION

Figure 1:
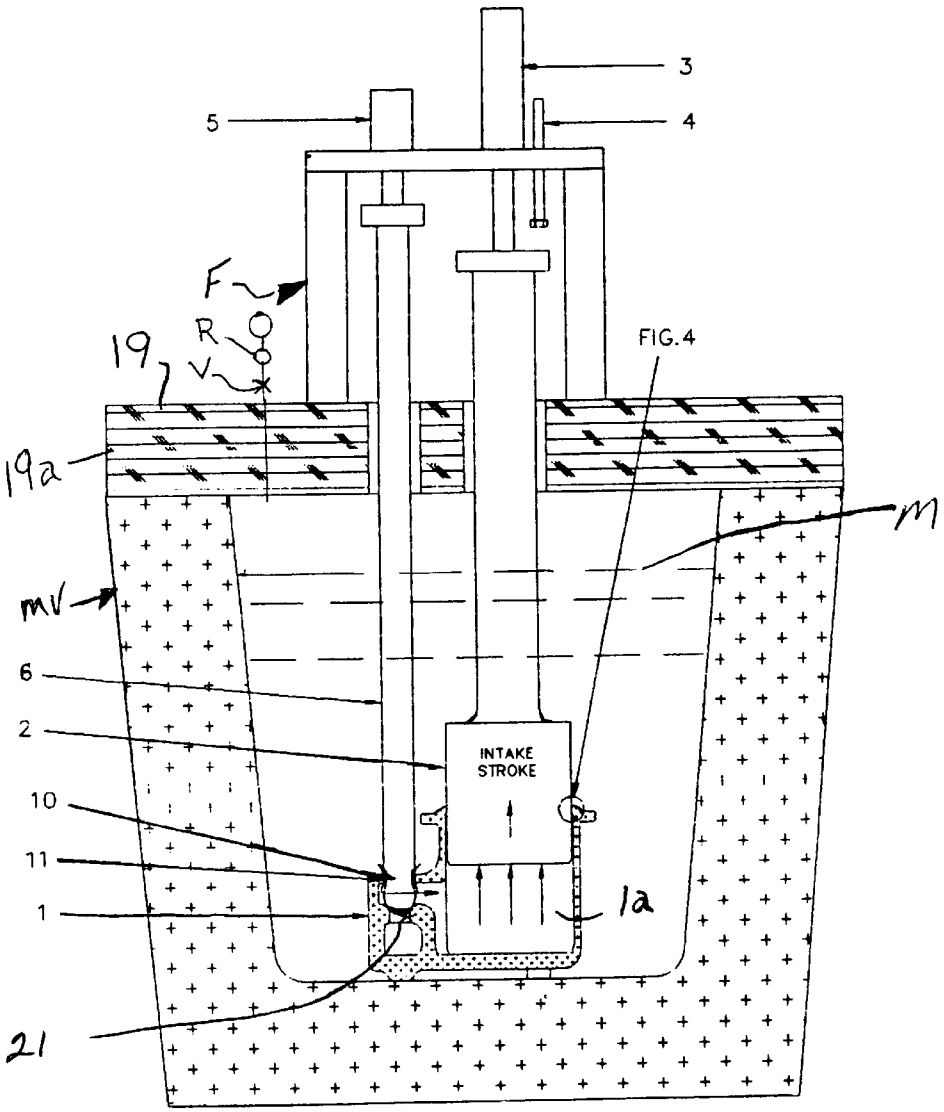
FIG. 1 is a sectional view of a molten metal pump during an intake stroke.

FIGS. 1, 1A, 1B, 1C, and 1D show a refractory or ceramic pump vessel or body 1 submerged in molten metal M, such as aluminum, in a melt holding vessel MV. A steel vessel MV can be used to hold magnesium and other less aggressive metals.

An inert or non-reactive gaseous atmosphere can be provided over the molten metal M in the vessel MV to reduce formation of oxides in the molten metal that may otherwise result from reaction of the molten metal M with air. Gases such as argon and nitrogen may be used as inert or nonreactive atmosphere over the molten metal M in the vessel MV to reduce or avoid oxide formation in the molten metal M in the vessel MV. A positive gas pressure in the range of 0.02 to 0.05 psi above atmosphere, as well as other pressure levels, can be provided over the molten metal in the vessel MV. The inert or non-reactive gas can be introduced into the vessel MV over the molten metal from a conventional gas source S, such as a gas cylinder or shop gas, via a gas conduit CD extending through the cover plate 19/insulation 19*a*, or the sidewall of vessel MV, and communicated to the interior of vessel MV. A conventional gas regulator R and needle type flow rate control valve V, typically are provided in the conduit CD to control flow of the inert or non-reactive gas.

A piston 2 of ceramic material (e.g. SiN bonded SiC for molten aluminum) is powered by a fluid cylinder 3 (e.g. hydraulic cylinder) to draw a charge of molten metal M into the ceramic pump vessel or body 1, which typically comprises a similar ceramic material as piston 2. The charge of molten metal is drawn through the inlet orifice 11 of the pump vessel or body 1 in an intake stroke, FIGS. 1A, 1B. The cylinder 3 raises the piston 2 until the adjusting screw 4 stops it, thus establishing a measured volume of molten metal that can be drawn into and then expelled from chamber la of pump vessel or body 1.

Figures 1A, 1B:
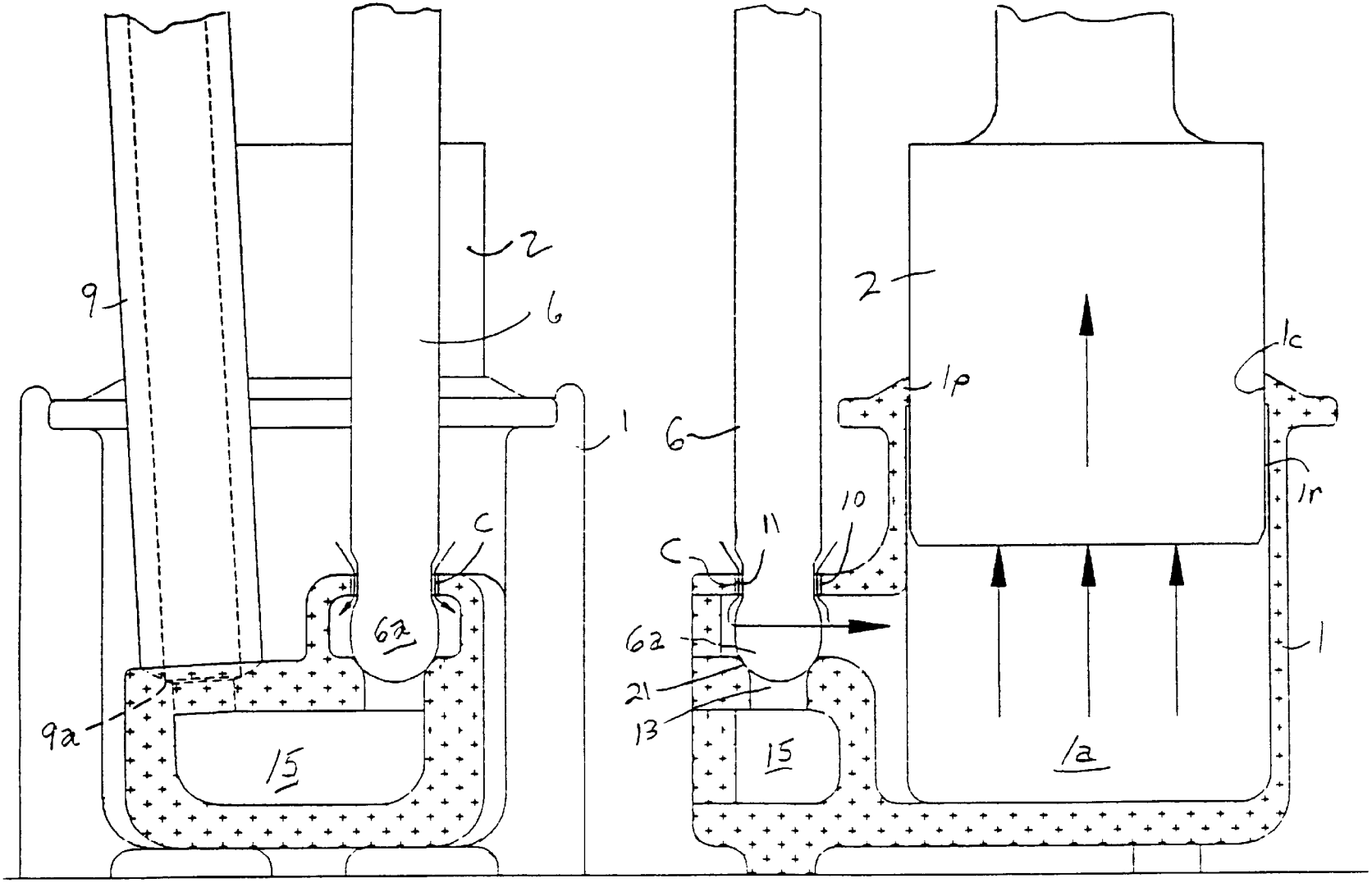
FIGS. 1A, 1B (during intake stroke), 1C, and 1D (during pumping stroke) are enlarged views of the inlet orifice and the outlet orifice of the pump vessel or body.
Figures 1C, 1D:
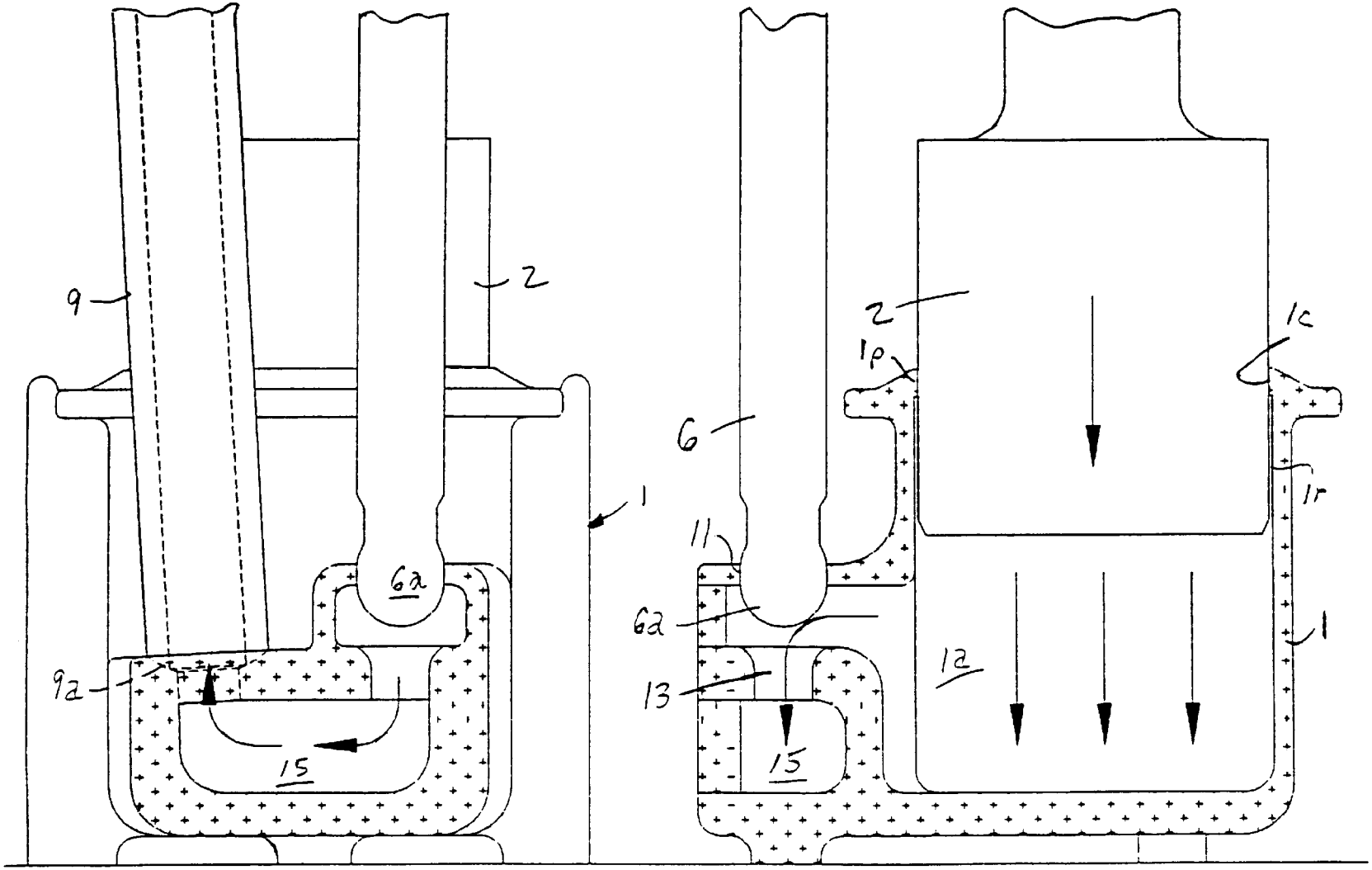

In particular, a clearance 10 is provided between the necked down region of stopper rod 6 and the inlet orifice 11 to allow molten metal to be drawn through clearance into pumping chamber la of the pump vessel or body 1 when the stopper rod is extended downwardly to the position shown in FIG. 1A. During a pump stroke of the piston 2, the stopper rod 6 is raised to a closed position closing off inlet orifice 11 as shown in FIGS. 1C, 1D, and 2–3 and opening outlet orifice 13 to discharge pipe 9. The stopper rod 6 is lowered/raised by fluid cylinder 5(e.g. hydraulic cylinder).

Figure 2:
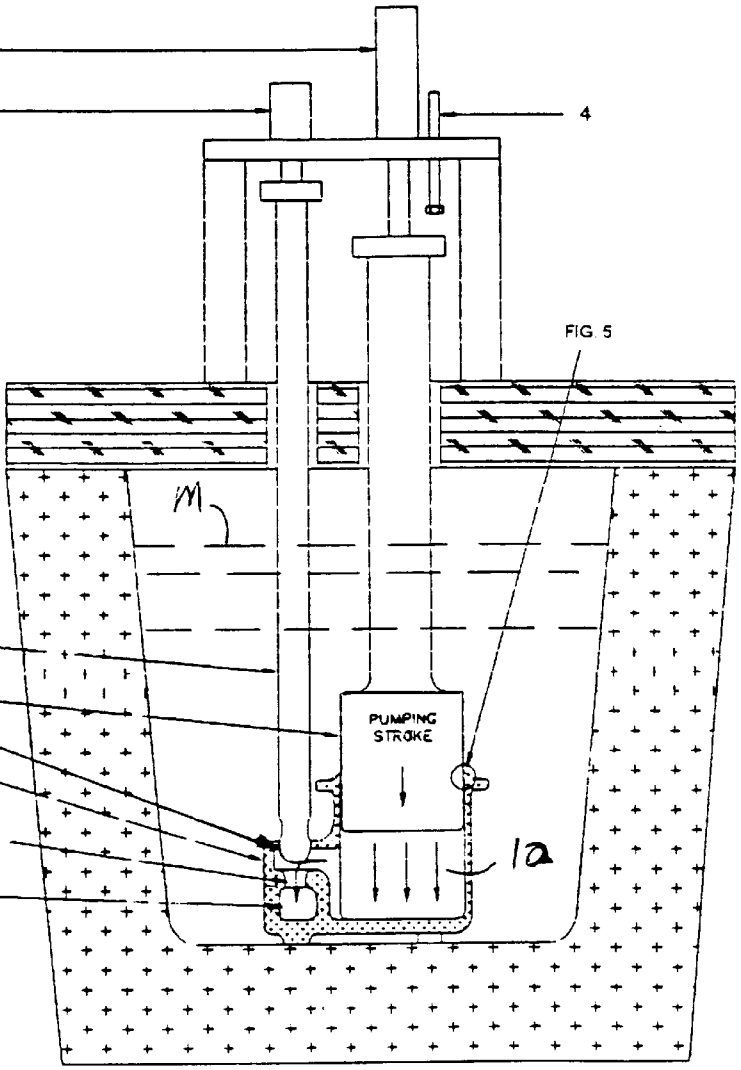
FIGS. 2 and 3 are sectional views of the molten metal pump with the molten metal being expelled up a discharge pipe during a pump stroke.
Figure 3:
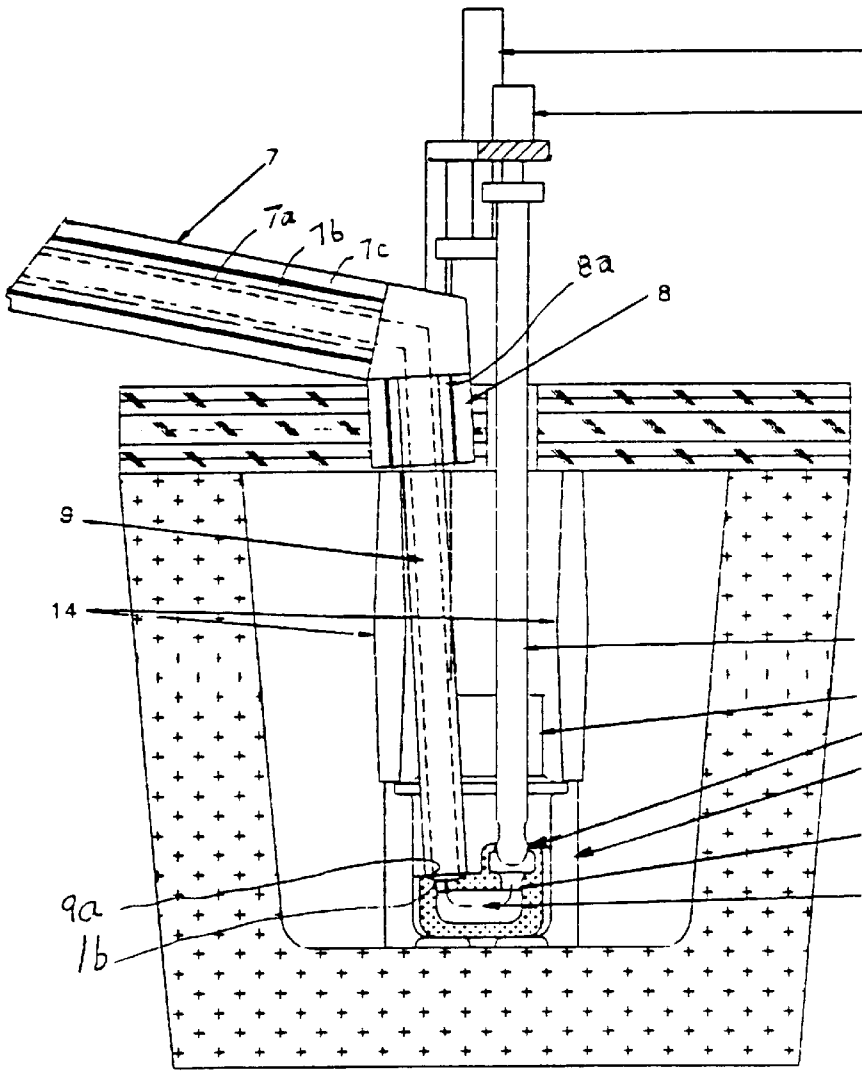

FIGS. 2 and 3 show the molten metal M in the pumping chamber 1*a* of ceramic pump vessel or body 1 being discharged through the outlet orifice 13 by the advancing piston 2 after the stopper rod 6 has been raised by the cylinder 5 so that the diameter of a spherical shaped end 6*a* of the stopper rod 6 registers with and closes off the inlet orifice 11, while outlet orifice 13 is opened to chamber la to allow the molten metal M to be pumped down through the outlet orifice 13 and then through the internal outlet passage 15 and up into the discharge pipe 9. When the cylinder 3 has fully extended the piston 2 to the end of the pumping stroke, the piston 2 will stop. The cylinder 5 will be actuated to extend stopper rod 6 downwardly to close off outlet orifice 13 and thereby block the molten metal from leaving the discharge pipe 9, FIG. 1, and allow the pump vessel or body 1 to be refilled upon demand through inlet orifice 11 during the next intake stroke.

The fluid cylinders 3 and 5 are mounted on a support frame F supported on a steel cover plate 19 having thermal insulation 19a thereon. From the above, it is apparent that the piston 2 can be raised/lowered during long intervals when the pump is not required to deliver molten metal while the stopper rod 6 maintains its position of FIG. 1 to continue to hold molten metal M in the discharge pipe 9. This feature of the invention eliminates stratification of the molten metal charge in the pumping chamber 1*a* of the pump vessel or body 1 and helps maintain uniform temperature of the charge.

The pump body 1 is held in position on the bottom of vessel MV by a plurality of ceramic hold-down legs 14 (e.g. 3 hold-down legs spaced 120° apart) engaging the upper wall of the pump body, FIG. 3.

Figure 4:
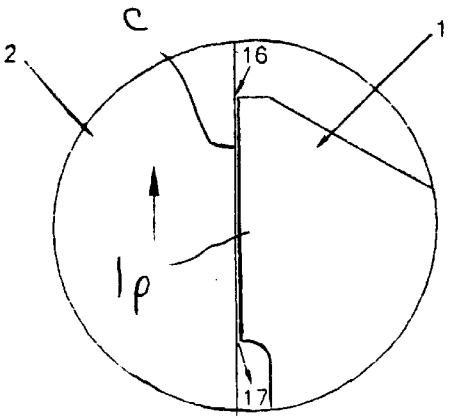
FIGS. 4 and 5 are enlarged views showing a clearance between the piston and the pump vessel providing a controlled molten metal leakage flow through the clearance for self-cleaning purposes.
Figure 5:
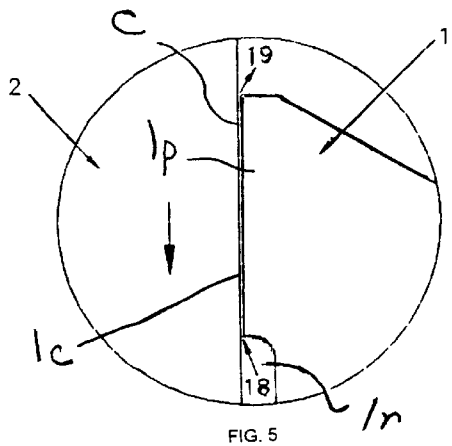

FIG. 4 shows an exploded view of the pump piston motion during the intake stroke. During the intake stroke there will be some controlled molten metal leakage as a result of pressure differential in the direction of the arrows 16 and 17. Oxide contaminant particles (e.g. dross) in the molten metal being drawn into the operating clearance C between the cylindrical piston 2 and the axially short annular cylindrical lip 1*p* of the vessel body 1 in the direction of the arrow 16 that are large enough to cause friction will be immediately carried up and out of the clearance by any friction generated by the retracting piston 2. FIG. 5 shows an exploded view of the pump piston motion during the pumping stroke. During the pumping stroke there will be some controlled molten metal leakage as a result of pressure differential in the direction of the arrows 18 and 19. Oxide contaminant particles (e.g. dross) in the molten metal being drawn into the operating clearance C between the cylindrical piston 2 and annular lip 1*p* in the direction of the arrow 18 that are large enough to cause friction will be immediately carried down and out of the clearance by any friction generated by the advancing piston 2. The operating clearance C, for example, is 0.006 to 0.010 inch on diameter of the piston 2 to this end. The oxide contaminant particles travel into radially enlarged cylindrical recess 1*r* below lip 1*p*. The recess 1*r* extends to the bottom of the pumping chamber 1*a* to receive such oxide contaminant particles. The shortness of axial lip 1*p* facilitates removal of such oxide particles (e.g. dross) from clearance C during both the intake and pumping strokes as described above.

The invention is advantageous in that the spherical end 6*a* of the stopper rod 6 eliminates alignment problems with the rounded seat 21 at outlet orifice 13 and with the cylindrical inlet orifice 11.

Moreover, the upstanding discharge pipe 9 includes a partial spherical end 9*a* engaging a partial spherical seat 1*b* on the vessel body 1, FIGS. 2–3. This is advantageous to eliminate the need for precise alignment between the pump outlet passage 15 and the remainder of the molten metal delivery system, such as supply pipe 7 to a casting machine. Supply pipe 7 may include an inner refractory pipe 7*a* with an electrical resistance heating element 7*b* and thermal insulation 7*c* thereabout. An electrical resistance heating element 8*a* and thermal insulation 8 may be disposed about the upper end of discharge pipe 9.

The piston 2 moves in a short finished (machined) cylindrical bore 1*c* defined by annular lip 1*p* of the pump vessel or body 1, permitting minor misalignment of the piston 2 and the pump vessel or body 1. The axial length of the piston-receiving bore 1*c* in the pump vessel or body 1 is, for example, 0.75 inch to 1.5 inch to this end.

The invention thus provides apparatus for pumping molten metal up a discharge pipe and into a casting mold or die cast shot sleeve (not shown but communicated to supply pipe 7) and holding the metal at its highest point in the discharge pipe while replenishing the pumping chamber 1*a* with molten metal for the next specific volume of molten metal to be pumped up the discharge pipe 9 without allowing metal to flow backward in the discharge pipe 9 at any time.

What is claimed is:

1. A molten metal pump, comprising a pump body having a pumping chamber with an inlet and with an outlet communicated to a discharge pipe, a pump piston movable in said pumping chamber, and a stopper rod operable during a piston intake stroke to open said inlet to allow said pumping chamber to be recharged with molten metal through said inlet and operable to close said outlet to block molten metal in said discharge pipe and then in a piston pumping stroke to block said inlet sufficiently to allow said piston to force an amount of molten metal from said pumping chamber through said outlet up said discharge pipe.

2. The pump of claim 1 wherein the pump body includes a short bore receiving the piston, said piston having a length greater than a length of said bore.

3. The pump of claim 1 wherein the piston can be cycled in said pumping chamber during long intervals when the pump is not required to deliver molten metal while the stopper rod closes the outlet to hold molten metal in the discharge pipe.

4. The pump of claim 1 wherein the stopper rod is opened and closed by a fluid cylinder disposed above an upper level of molten metal in which said pump body is submerged.

5. A molten metal pump, comprising a pump body having a bore and a piston movable in the bore with an operating clearance between said bore and said piston, said piston having a length greater than a length of said bore, such that said piston will dislodge contaminants being forced into said operating clearance between the piston and the pump body by pressure inside of the pump body during a pumping stroke and by pressure outside of the pump body during an intake stroke.

6. In a molten metal pump having a discharge pipe engaging a pump body, a spherical seat on the discharge pipe for engaging a spherical seat on the pump body so as to eliminate the need for perfect alignment between a pump outlet and a metal delivery system.

7. A molten metal pump, comprising a pump body having a pumping chamber with an outlet to a discharge pipe, a pump piston movable in said pumping chamber, and a stopper rod having a necked down region that defines with said pump body during a piston intake stroke an annular inlet communicated to said pumping chamber to allow said pumping chamber to be recharged with molten metal through said annular inlet and operable to close said outlet to block molten metal in said discharge pipe and then operable in a piston pumping stroke to block said inlet sufficiently to allow said piston to force an amount of molten metal from said pumping chamber through said outlet up said discharge pipe.

* * * * *